US005402942A

United States Patent [19]

Wiatr et al.

[11] Patent Number: 5,402,942

[45] Date of Patent: Apr. 4, 1995

[54] RAILWAY TIE COLLAR SYSTEM

[75] Inventors: Rudolph F. Wiatr, Norridge; John R. Sigle, Springfield, both of Ill.

[73] Assignee: Tie Collar, Ltd., Vernon Hills, Ill.

[21] Appl. No.: 275,117

[22] Filed: Jul. 14, 1994

Related U.S. Application Data

[63] Continuation of Ser. No. 51,044, Apr. 21, 1993, abandoned.

[51] Int. Cl.[6] ..... E01B 3/24; E01B 21/04

[52] U.S. Cl. ..... 238/300; 238/8; 238/110

[58] Field of Search ..... 238/6–8, 238/10 B, 10 C, 11, 12, 109–111, 300, 114, 115, 119

[56] References Cited

U.S. PATENT DOCUMENTS

| | | | |
|---|---|---|---|
| 431,846 | 7/1890 | Hull et al. | 238/111 X |
| 882,051 | 3/1908 | Clough | 238/300 X |
| 972,303 | 10/1910 | Wessels | 238/110 |
| 1,023,392 | 4/1912 | Pennock | 238/110 |
| 1,026,341 | 5/1912 | Burch | 238/110 |
| 1,031,177 | 7/1912 | Goble | 238/110 |
| 4,121,766 | 10/1978 | Wiatr et al. | 238/110 |
| 4,732,320 | 3/1988 | Owen | 238/8 |
| 5,096,117 | 3/1992 | Owen | 238/6 |

FOREIGN PATENT DOCUMENTS

| | | | |
|---|---|---|---|
| 3401 | of 1887 | United Kingdom | 238/110 |
| 224473 | 11/1924 | United Kingdom | 238/111 |

*Primary Examiner*—Michael S. Huppert
*Assistant Examiner*—Stephen Gordon
*Attorney, Agent, or Firm*—Juettner Pyle Lloyd & Piontek

[57] ABSTRACT

A tie collar having an upper wall for supporting a rail, an upper receptacle for receiving a cross tie, and a lower enlarged ground engaging portion is provided with an improved double wall feature for connecting the ends of the upper wall to the lower portion, and pedestal supports for supporting the primary and secondary ties in the construction of a railway crossing.

9 Claims, 3 Drawing Sheets

RAILWAY TIE COLLAR SYSTEM

This is a continuation of application Ser. No. 08/051,044, filed on Apr. 21, 1993, and now abandoned.

BACKGROUND OF THE INVENTION

The present invention relates to improvements in railway track support structures and more particularly to improvements in a sleeper or tie collar construction as shown in our U.S. Pat. No. 4,121,766, issued Oct. 24, 1978. That patent, incorporated herein by reference, discloses a track supporting railway tie collar which includes an upper receptacle for loosely receiving an end portion of a cross tie and an enlarged lower bell portion engaged in the ballast beneath the track structure. The rail is supported on a top wall or plate of the upper receptacle and transfers loads directly into the ballast via the bell housing rather than through the tie, thereby greatly prolonging the life of the tie and minimizing track maintenance.

The references cited in U.S. Pat. No. 4,121,766 show various types of solid rail support structures. Other similar railway tie supports are described in U.S. Pat. Nos. 1,425,104 and 1,550,925 and U.S. Ser. No. 224,473, French patent No. 984,858 and German patent No. 77463.

While the tie collar shown in U.S. Pat. No. 4,121,766 has proven to be greatly superior to conventional track structures wherein the train loads are transferred through wooden ties, there is a continuing need to provide improvements in such devices, particularly in terms of strength, load distribution and versatility. A particular concern is the track structure at railway crossings, which has a platform secured over the ties to facilitate the crossing of vehicles. The track structure at such locations is required to carry both vehicle and train traffic. The track cannot be maintained or the ties replaced without removal and subsequent replacement of the platform, which is an expensive and time consuming procedure. Other critical locations are found in switching and track crossing locations, especially those which receive a high degree of traffic and require frequent maintenance.

SUMMARY OF THE INVENTION

The tie collar of the present invention has a construction similar to that described in U.S. Pat. No. 4,121,766 and has an upper portion for supporting the rail and loosely receiving a cross tie, and a lower enlarged portion engaged in ballast. The improvements comprise an upper rail supporting wall or plate which is substantially elongated and is supported at each end by spaced transverse vertical inner and outer walls. The outer walls are curved or cylindrical and are directly connected to the lower bell-shaped portion to provide more efficient transfer of loads.

The upper portion is provided with a transverse opening to receive the end of a cross tie. The lower bell-shaped portion has opposed pedestals in line with the lower wall of the opening to provide additional support for the tie ends. Longitudinally spaced pedestals perpendicular and coplanar with the tie pedestals may be provided to support intermediate ties between the primary ties, which is especially useful when constructing a track crossing platform.

The tie collar of the present invention has a resonant frequency which is substantially higher than frequencies which can cause ballast dislocation or fracture. The additional rail contact provides better transfer of heat into the ballast and minimizes thermal distortion of the rails.

Other advantages and features will become apparent from the following description and drawings.

THE DRAWINGS

DESCRIPTION OF THE PREFERRED EMBODIMENTS

Figure 1:
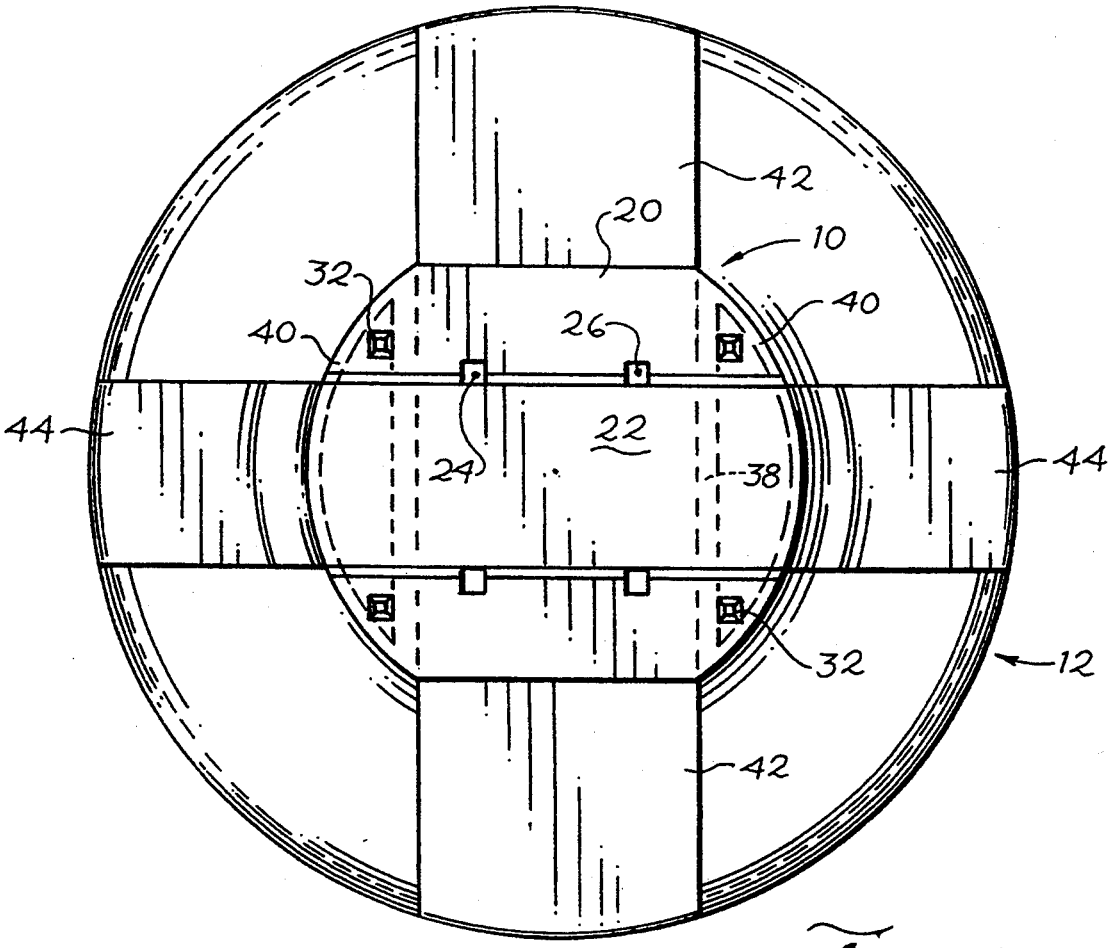
FIG. 1 is a plan view of the improved tie collar of the present invention.
Figure 2:
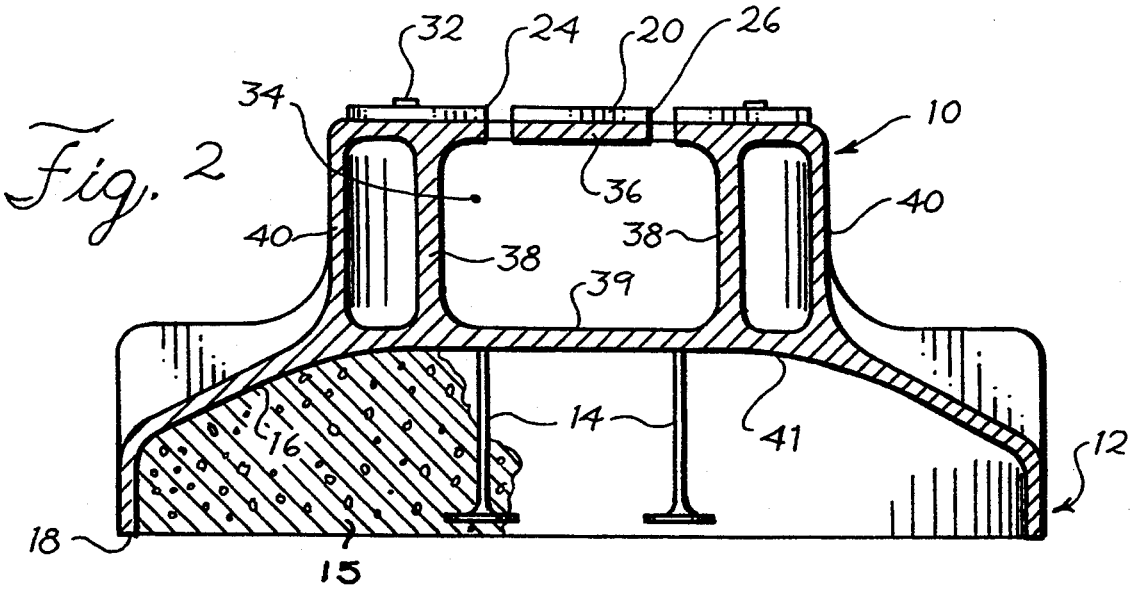
FIG. 2 is a longitudinal sectional view through FIG. 1.
Figure 3:
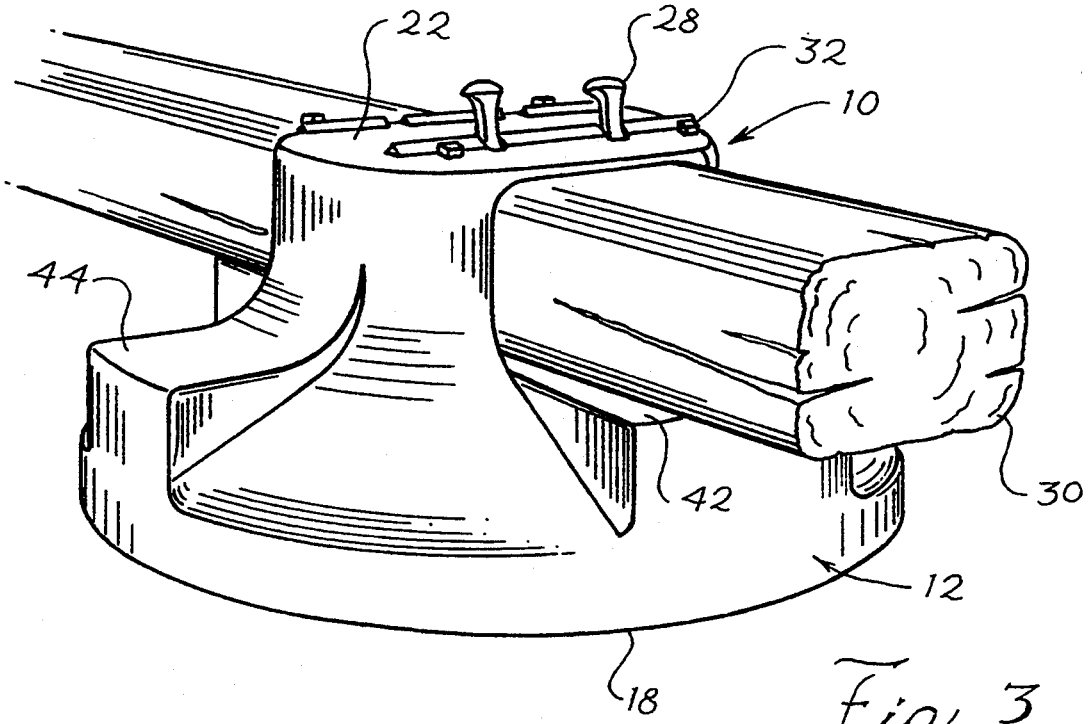
FIG. 3 is a perspective view of the tie collar shown in FIG. 1 in association with a tie.

As shown in FIGS. 1–3, the tie collar of the present invention is of one piece unitary construction of cast iron or steel and comprises an upper rail support and tie receiving portion 10 and a lower enlarged ballast or ground support portion 12 having a flattened bell shape. The underside of the lower portion 12 is concave and hollow at 16 and may be provided with pins 14 secured and depending therein. The hollow portion 16 may be filled with uncured concrete 15, and upon curing, the pins retain the concrete mass in the hollow cavity. The lower circular edge 18 of cavity is flat and planar and is adapted to rest on a flat bed surface which is prepared in advance.

The tie receiving and rail support portion 10 comprises a top plate 20 having a longitudinal rectangular channel 22 for receiving the base of a rail. Longitudinally spaced spike holes 24 and 26 extend through the top plate or wall 20 at the outer edges of the rail channel 22. Spikes 28 are driven through these openings into the cross tie 30 and serve to hold the base of the rail against lateral movement. Upstanding lugs 32 may be provided outwardly of the spike holes 24 and 26 to provide secondary constraint for the rail in the event that the rail escapes retention by the spikes.

The upper portion 10 has a transverse rectangular or square horizontal opening 34 therethrough to slidably and loosely receive a wooden tie 30. The opening 34 is defined by a top wall 36 extending beyond either side of the opening 34, a pair of inner transverse vertical planar walls 38, and a bottom wall 41, which is part of and integral with the lower bell portion 12. The top plate 20 is preferably separate from the top wall 36, with the plate being secured thereto such as by welding. This allows different configurations of rail support in the top plate, as will be later described.

The longitudinal ends of the top wall 36 and associated plate extend beyond the inner walls 38, with the ends being supported by outer curved or cylindrical vertical walls 40 which are connected between said ends and the lower bell portion 12. As shown in FIG. 1, these outer walls 40 merge with the inner walls 38 in a D configuration but are otherwise spaced therefrom to provide a box section. This allows for an increased longitudinal support surface for the rail while minimizing weight. Since a greater length of the rail is in contact with the top wall and plate, there is better heat conduction into the tie collar, as well as other benefits described herein.

A pair of flat pedestals or platforms 42 are secured from the lower portion 12 and are in alignment with the bottom wall surface 39 on both sides of the transverse tie opening 34. The platforms 42 have an upper flat surface and provide additional support for the tie and serve to minimize any bending moments thereon.

A second pair of flat pedestals or platforms 44 are secured to the lower bell portion 12 beyond the ends of the upper wall 36 and are substantially complanar with the other pedestal surfaces 42 and bottom wall surface 39. The purpose of these platforms 44 is to support secondary ties 46 between adjacent tie collars (FIG. 4) to provide a better foundation for a crossing platform as will be described below.

In common with our previous patent, the ties 30 are loosely received in the openings of the tie collar and serve substantially only to maintain the gauge between adjacent parallel rails. All of the weight of the passing train is borne by the structure of the tie collar itself and the underlying ballast. The resonant frequency of the tie collar, greater than 30 Hz and preferably in the order of 70 to 80 Hz, is due to the enlarged top plate and double wall construction, and enlarged bell housing, and is substantially higher than frequencies which would cause damage or excessive dislocation of the ballast, which are associated with conventional track, which frequencies are in the order of 3 to 10 Hz.

Figure 5:
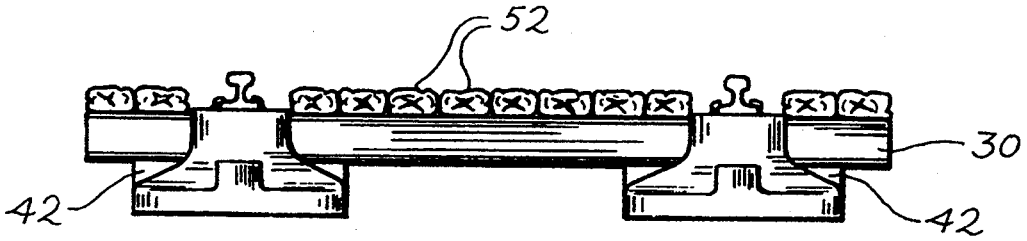
FIG. 5 is an end view of a pair of spaced tie collars connected by a tie and having a platform applied thereto.
Figure 4:
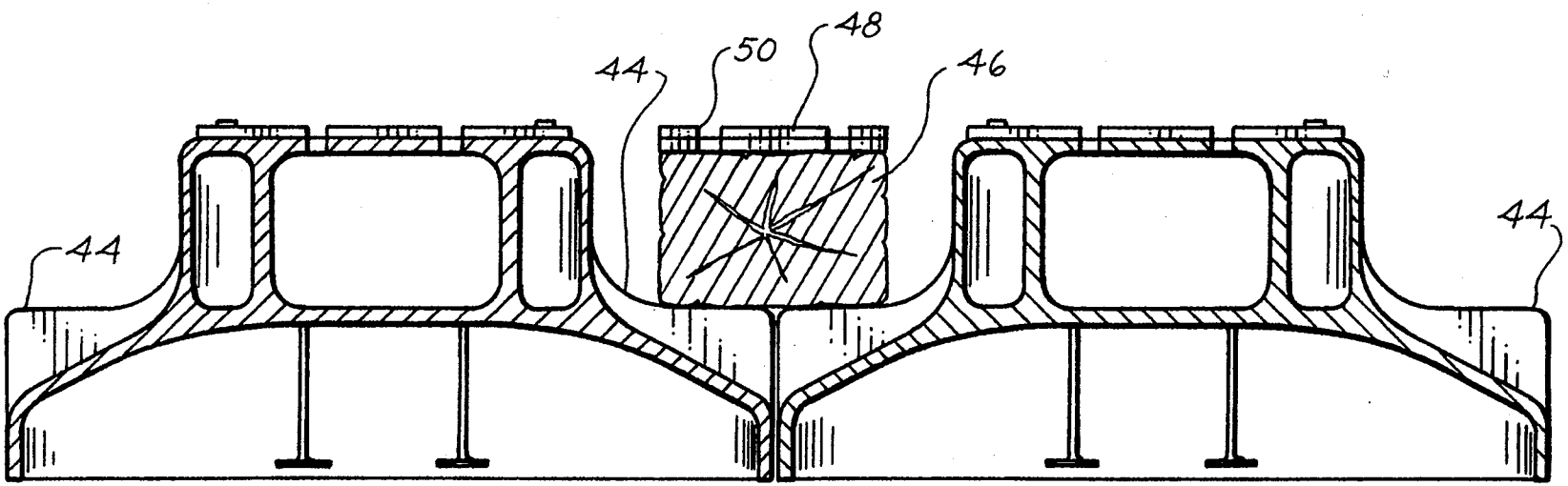
FIG. 4 is a sectional view through a pair of adjacent tie collars and associated ties.

FIGS. 4 and 5 illustrate the beneficial use of the tie collar platforms 42 and 44 when constructing a vehicle crossing across the tracks. Normally, the weight of these vehicles is borne by the cross ties, thus greatly decreasing the service life of the track at crossings, in comparison to other sections of track.

As shown in FIG. 4, each track is supported by a plurality of tie collars, with adjacent tie collars being in abutting relation as shown, with the platforms 44 of adjacent collars being substantially coplanar. The end of a secondary or intermediate tie 46 may be supported on platforms 44, and the top of the tie may carry a channeled tie support plate 48 spiked through holes 50 to the tie 46. As shown in FIG. 5, longitudinal planks 52 or other surfacing are affixed to the primary 30 and secondary 46 ties, such as by bolting, with the primary ties being additionally supported by the pedestals 42. Thus, some of the load caused by vehicles on the crossing is borne by the tie collars. To the extent that 16ads are borne by cross ties, the loads will be the greatest near the ends, where additional support is provided.

Whereas in normal circumstances the tie collars are supported in ballast, at crossing locations the ballast may be omitted. Thus, the tie collars serve to elevate or space the ties and platform structure above the ground. This facilitates the draining of water and minimizes deterioration of the wood member.

Figure 6:
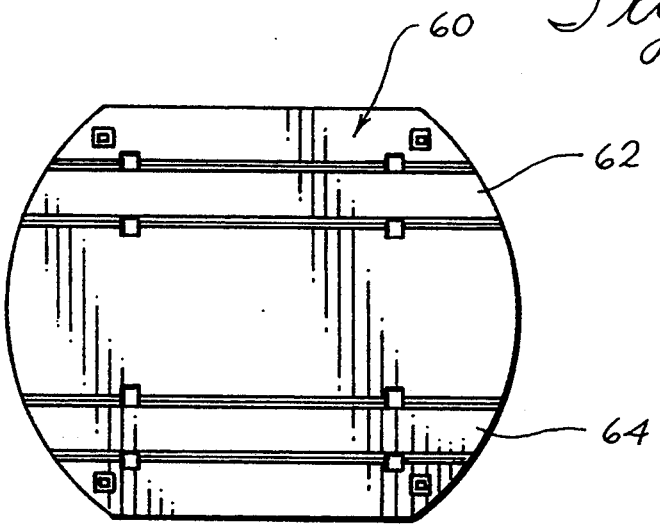
FIG. 6 is a plan view of another embodiment of a top plate for supporting more than one rail.

FIG. 6 shows another embodiment of a top plate 60, which is intended to be used with a larger version of the tie collar. In this embodiment, there are a pair of spaced rail channels 62 and 64 for receiving two rails in a spaced relation, with the channels being either in parallel or at an acute angle. The support of more than one rail is useful in many applications such as switching locations.

We claim:

1. An improved railway tie collar for supporting a rail comprising a lower enlarged ground engaging bell, said bell having an upper wall, a first pair of spaced transverse vertical walls secured to said upper wall, a horizontal top wall secured between said first pair of vertical walls and defining therewith and said upper wall a transverse open ended cavity, a second pair of transverse vertical walls spaced outwardly from said first pair of transverse vertical walls and secured between said upper wall and said top wall, and means for securing a rail to said top wall.

2. The improved tie collar of claim 1 wherein said second pair of transverse vertical walls are substantially cylindrical and have ends which merge with said first pair of transverse vertical walls.

3. The improved tie collar of claim 1 wherein the means for securing a rail to said top wall comprises a longitudinal channel in said top wall.

4. The improved tie collar of claim 3 additionally comprising a stop lug on both sides of said channel.

5. The improved tie collar of claim 1 wherein said tie collar has a resonant frequency of less than 30 Herz.

6. The improved tie collar of claim 1 additionally comprising a pair of tie support platforms on said bell at opposite sides of said cavity, said tie support platforms being substantially level with said upper wall.

7. The improved tie collar of claim 1 wherein said lower ground engaging bell is filled with cured concrete.

8. A railway tie collar comprising a lower enlarged ground engaging bell having an upper wall, means for supporting a primary cross tie comprising a top wall and a pair of transverse vertical walls secured between said top wall and said upper wall to define a transverse open end cavity, and means for supporting a secondary tie comprising a ledge extending from said bell and having an upper surface, said upper surface being substantially level with said upper wall.

9. A railway rail and crossing structure comprising a plurality of opposed spaced pairs of tie collars arranged in parallel lines, each of said tie collars comprising an enlarged lower ground engaging portion, an upper portion, and a transverse open ended cavity through said upper portion, the tie collars in each line being in a closely spaced relationship, a plurality of cross ties extending between the opposed fie collars and received in the transverse cavities thereof, horizontal support surfaces on the lower portions of adjacent tie collars, a plurality of secondary cross ties supported on said horizontal support surfaces between opposed tie collars, and a crossing structure supported on said primary and secondary ties.

* * * * *